US005296823A

United States Patent [19]

Dietrich

[11] Patent Number: 5,296,823

[45] Date of Patent: Mar. 22, 1994

[54] WIDEBAND TRANSMISSION LINE BALUN

[76] Inventor: James Dietrich, 1642 N. Baltimore Ave., Derby, Kans. 67037

[21] Appl. No.: 940,656

[22] Filed: Sep. 4, 1992

[51] Int. Cl.[5] ..... H01P 5/10

[52] U.S. Cl. ..... 333/26; 333/161

[58] Field of Search ..... 333/120, 25, 26, 161, 333/164

[56] References Cited

U.S. PATENT DOCUMENTS

| | | | |
|---|---|---|---|
| 2,138,906 | 12/1938 | Cork et al. | 333/26 X |
| 3,066,266 | 11/1962 | Fisher | 333/25 |
| 3,327,220 | 6/1967 | Podell . | |
| 3,357,023 | 12/1967 | Hemmie | 343/821 |
| 3,428,886 | 2/1969 | Kawashima et al. | 333/33 |
| 3,678,418 | 7/1972 | Woodward | 333/26 |
| 3,846,721 | 11/1974 | Fritz et al. | 333/26 |
| 4,201,962 | 5/1980 | Hosoya | 333/25 |
| 4,295,107 | 10/1981 | Perlow | 333/25 |
| 4,612,520 | 9/1986 | Boire et al. | 333/164 X |
| 4,631,504 | 12/1986 | Matsuda et al. | 333/25 |
| 4,764,773 | 8/1988 | Larsen et al. | 333/25 X |
| 5,148,130 | 9/1992 | Dietrich | 333/25 |
| 5,172,082 | 12/1992 | Livingston et al. | 333/161 X |

*Primary Examiner*—Paul Gensler

[57] ABSTRACT

A wideband transmission line balun divides an input signal equally between a single-conductor transmission line and a polarity reversing, two-conductor transmission line thereby providing balanced signals at the transmission line outputs. Simple printed circuit and shielded structures include a ferrite core interactive with the two-conductor transmission line for parasitic mode suppression.

13 Claims, 3 Drawing Sheets

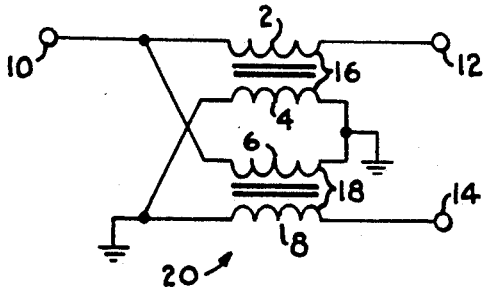
Fig. 1. PRIOR ART
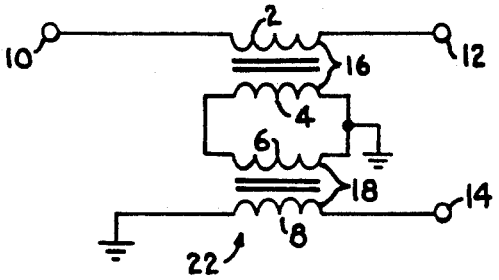
Fig. 2. PRIOR ART
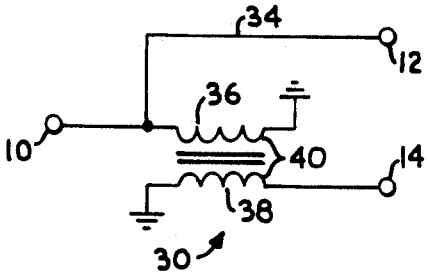
Fig. 3.
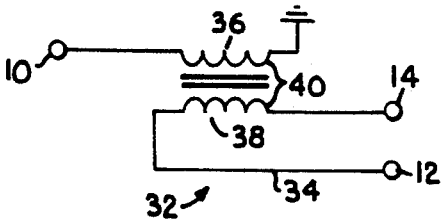
Fig. 4.
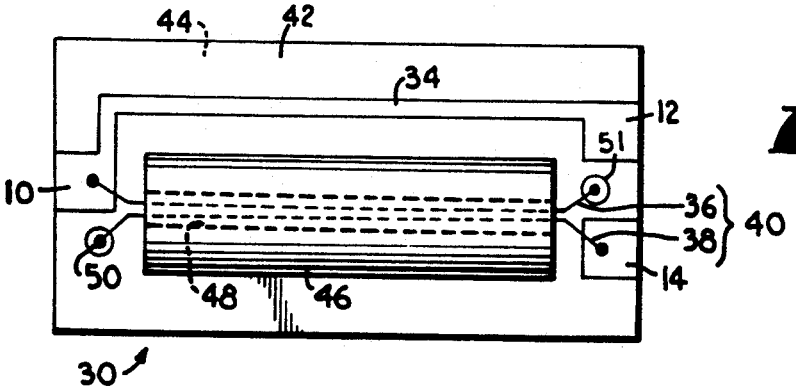
Fig. 5.
Fig. 6.
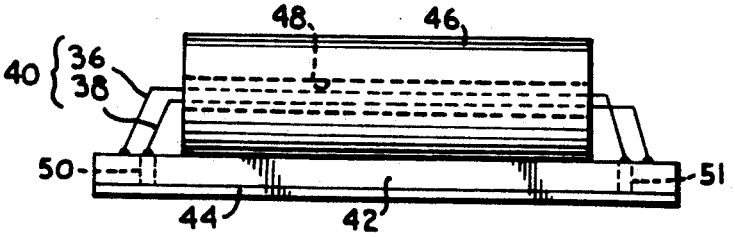

Fig. 7.
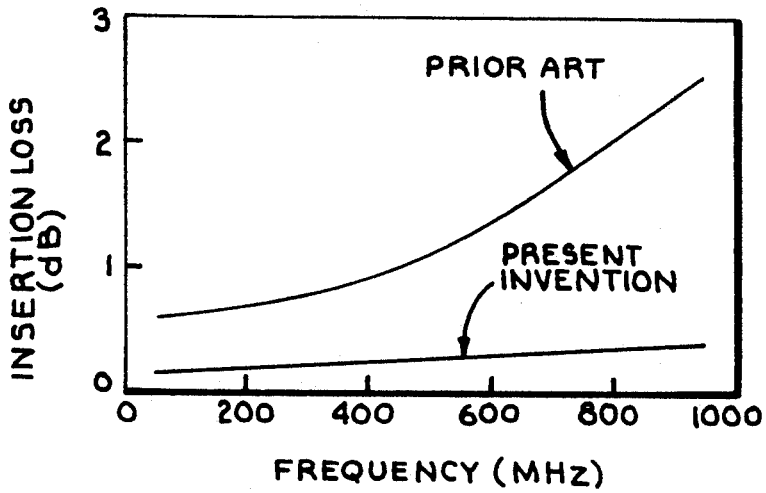
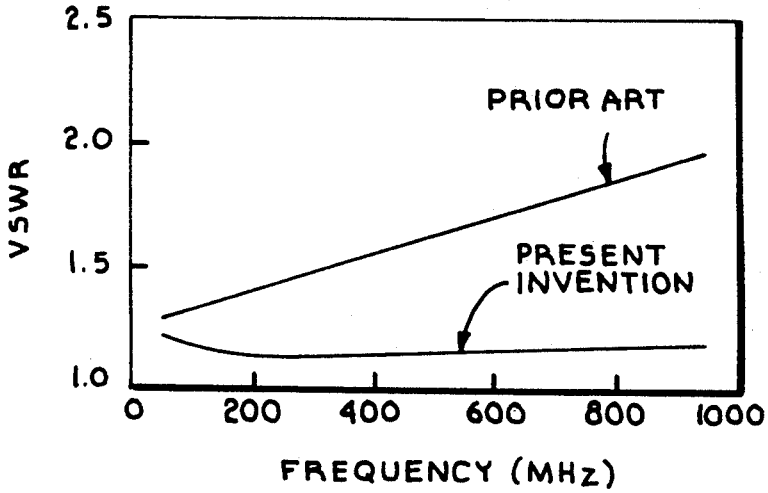
Fig. 8.
Fig. 9.
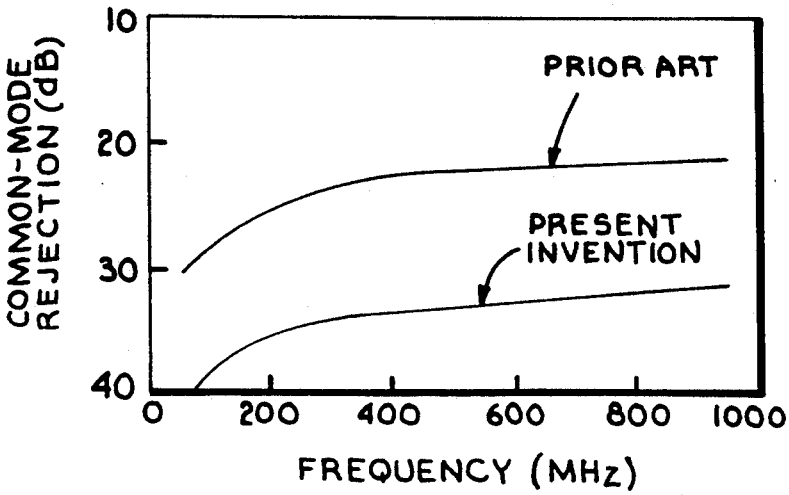

WIDEBAND TRANSMISSION LINE BALUN

BACKGROUND OF THE INVENTION

The present invention relates to baluns, that is transformers capable of coupling a single-ended input to a balanced output and vice versa.

A balun is used to connect together many different types of electronic devices including antennas, transmission lines and electronic circuits when one device is single-ended or unbalanced and the other device is balanced. For example, a receiving system may comprise a balanced antenna which feeds an unbalanced coaxial transmission line which in turn carries signal energy to a receiver having a balanced input. In such a case, a balun is required at the antenna-coax cable interface and at the coax cable-receiver interface for the system to operate properly. Furthermore, RF signal processing components and circuitry inside a receiver often utilize baluns for their interconnection. In addition, at the component or circuit level, a balun may be an integral part of the design to achieve a particular function or level of performance.

In the RF frequency range 1 MHz–2 GHz, baluns are used extensively in many different applications and so a wideband balun which can function over a substantial portion of this frequency range has great utility. It can be used in applications where a wide range of frequencies will be present and alternatively it can provide a single-device solution to many different narrow frequency band problems.

Well-known prior art wideband baluns 20, 22 are shown schematically in FIGS. 1, 2 respectively. Coils 2, 4, 6 and 8 are bifilar windings, where coils 2 and 4 comprise two-wire transmission line 16 and coils 6 and 8 comprise two-wire transmission line 18. Transmission lines 16 and 18 may be wound on individual magnetic cores or on a single, two-hole core. An impedance connected to single-ended terminal 10 will match a balanced impedance connected between balanced terminals 12 and 14. In FIG. 1, transmission line 16 is connected in parallel with transmission line 18 between single-ended terminal 10 and signal ground. Balun 20 is therefore known as a parallel-connected balun and provides a balanced-to-unbalanced impedance matching ratio of 4:1. In FIG. 2, transmission line 16 is connected in series with transmission line 18 between single-ended terminal 10 and signal ground. Balun 22 is therefore known as a series-connected balun and provides a balanced-to-unbalanced impedance matching ratio of 1:1. For an impedance of designated value $Z_0$ connected to unbalanced terminal 10, the preferred values of characteristic impedance for two-wire transmission lines 16, 18 are $2Z_0$ for parallel-connected balun 20 and $Z_0/2$ for series-connected balun 22.

There are several known variants of the above-described wideband baluns. U.S. Pat. No. 3,357,023 to Hemmie shows two-wire transmission lines wound on an insulating core rather than a magnetic core. This eliminates magnetic core losses but limits the low-frequency response and bandwidth.

In U.S. Pat. No. 3,327,220 to Podell, a two-wire transmission line passes thru a magnetic core rather than being wound as a coil.

In U.S. Pat. No. 3,846,721 to Fritz et al., two-conductor transmission lines are disposed on a dielectric substrate.

Stray coupling between the two-conductor transmission lines and loss of signal energy in the magnetic core material are important limitations to the electrical performance of prior art wideband baluns. The widely used method of winding both two-wire transmission lines on a single, two-hole core causes troublesome manufacturing difficulty.

SUMMARY OF THE INVENTION

Accordingly, it is an object of the present invention to provide a balun with improved electrical operating characteristics.

It is another object of the present invention to provide a balun in which the electrical operating characteristics are more readily selectively improved.

A further object of the present invention is to provide a balun with wide bandwidth.

A still further object of the present invention is to provide a balun that is simple to construct so as to be readily producible at low cost.

These and other objects are achieved by the present invention which comprises a two-conductor transmission line and a single-conductor transmission line, each transmission line being of equal electrical length and having an input and an output. The two-conductor transmission line is connected to provide signal polarity reversal from input to output while the single-conductor transmission line has the same signal polarity from input to output. By connecting the two transmission line inputs in parallel, a 4:1 balun is formed. Connecting the two transmission line inputs in series gives a 1:1 balun. Wide bandwidth may be provided by including a single magnetic core interactive with the two-conductor transmission line.

Other and further aspects of the present invention will become apparent during the course of the following description and by reference to the accompanying drawings.

BRIEF DESCRIPTION OF THE DRAWINGS

FIG. 1 is a schematic diagram showing a prior art balun having a 4:1 impedance matching ratio;

FIG. 2 is a schematic diagram showing a prior art balun having a 1:1 impedance matching ratio;

FIG. 3 is a schematic diagram showing a balun according to the present invention having a 4:1 impedance matching ratio;

FIG. 4 is a schematic diagram showing a balun according to the present invention having a 1:1 impedance matching ratio;

FIG. 5 is a top plan view of a dielectric substrate with conductive pattern and components implementing an embodiment of the present invention as shown in FIG. 3;

FIG. 6 is a side view of FIG. 5 and illustrates a ground conductor and connections thereto;

FIG. 7 is a graph showing measured insertion loss vs. frequency for a balun of the present invention compared to that of a conventional balun;

FIG. 8 is a graph showing measured VSWR vs. frequency for a balun of the present invention compared to that of a conventional balun;

FIG. 9 is a graph showing measured common-mode rejection vs. frequency for a balun of the present invention compared to that of a conventional balun;

DETAILED DESCRIPTION OF THE INVENTION

Figure 10:
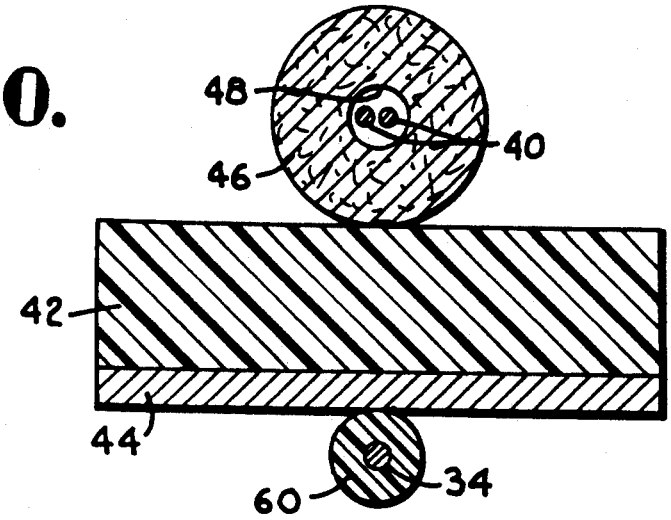
FIG. 10 is a cross sectional view showing a transmission line structural geometry applicable to the present invention.

Referring to FIGS. 3 and 4, baluns 30 and 32 of the present invention are schematically shown to comprise a single-conductor transmission line 34 and conductors 36 and 38 which together form two-conductor transmission line 40. Transmission lines 34 and 40 are of equal electrical length. At one end of transmission lines 34 and 40, transmission line 34 is connected to balanced terminal 12, conductor 38 is connected to balanced terminal 14 and conductor 36 is connected to signal ground. At the opposite end of transmission lines 34 and 40, conductor 36 is connected to single-ended terminal 10. Additionally, in FIG. 3, transmission line 34 is connected to single-ended terminal 10 and conductor 38 is connected to signal ground while in FIG. 4, transmission line 34 is connected to conductor 38.

In baluns 30 and 32, signal energy introduced at single-ended terminal 10 divides equally between transmission lines 34 and 40. The signal output of transmission line 34 appears at terminal 12 with unchanged polarity while the signal output of transmission line 40 appears at terminal 14 with reversed polarity. These equal-amplitude, anti-phase signals define a balanced output between terminals 12 and 14. In a reciprocal manner, balanced signal energy introduced at terminals 12, 14 is combined in baluns 30, 32 giving an output at single-ended terminal 10.

Transmission lines 34, 40 being connected in parallel and series respectively at single-ended terminal 10 of baluns 30 and 32, thereby provided balanced-to-unbalanced impedance matching ratios of 4:1 and 1:1. For a reference impedance of value $Z_0$ connected at single-ended terminal 10, preferred values of characteristic impedance for transmission lines 34 and 40 are $2Z_0$ for balun 30 and $Z_0/2$ for balun 32. These values allow transmission lines 34 and 40 to operate free of reflected signals for good impedance matching over wide bandwidth. Other values may be used to give matching ratios other than 4:1 and 1:1 but with a bandwidth reduction.

Two-conductor transmission line 40 contributes parasitic transmission modes between conductor 36 and signal ground and between conductor 38 and signal ground. Any number of well-known methods may be used either singly or in combination to minimize the unwanted effects of these parasitics, including the use of ferrite magnetic material, forming transmission line 40 into a coil and making transmission line 40 one-quarter wavelength long. These methods serve to inhibit energy flow in the parasitic modes while leaving the main transmission mode relatively unaffected. Transmission line 34 is a single-ended transmission line that is free from parasitic transmission modes so that ferrite cores and other measures are completely unnecessary. Furthermore, unwanted coupling between transmission lines 34 and 40 is significantly less than in prior art devices (lines 16, 18 in FIGS. 1, 2) because transmission line 34 is strongly coupled to signal ground which isolates it from transmission line 40.

An embodiment of balun 30 of FIG. 3 is illustrated in FIGS. 5 and 6 where dielectric substrate 42 has signal ground conductor layer 44 applied to the complete lower surface. The upper surface of dielectric substrate 42 contains components comprising balun 30. A disposed conductive pattern (as viewed in FIG. 5) comprises single-ended terminal 10, balanced terminals 12, 14 and transmission line 34. Single-ended terminal 10 is at the left edge of dielectric substrate 42 and balanced terminals 12, 14 are at the right edge of dielectric substrate 42. Transmission line 34 connects between single-ended terminal 10 and balanced terminal 12. A ferrite core 46 contains a central passage 48 thru which pass conductors 36, 38 comprising transmission line 40. At the left end of transmission line 40, conductor 36 connects to single-ended terminal 10 and conductor 38 connects to signal ground via 50. At the right end of transmission line 40, conductor 38 connects to balanced terminal 14 and conductor 36 connects to signal ground via 51. The embodiment of balun 30 shown in FIGS. 5 and 6 may be altered to achieve balun 32 of FIG. 4 by simply connecting transmission line 34 to conductor 38 at the left end after their respective disconnection from single-ended terminal 10 and signal ground via 50.

The embodiment of FIGS. 5 and 6 is well-suited for wideband operation of baluns 30, 32 of the present invention. The uniform characteristics of transmission lines 34, 40 over their lengths contribute to good high-frequency operation as does the absence of parasitic modes in transmission line 34. Because only one two-conductor transmission line is used, there is a space savings which may be used to better suppress the parasitic effects of transmission line 40. For example, transmission line 40 may be lengthened or ferrite core 46 may be increased in size. This space savings may also be used to produce a smaller balun device. Stray couplings present in conventional devices include interwinding coupling, input-output coupling and coupling between the two transmission lines. These are largely eliminated in the present embodiment due to straight-line construction of transmission lines 34 and 40, separation of single-ended terminal 10 and balanced terminals 12, 14 and the effective isolation of transmission line 34 from transmission line 40 by the presence of signal ground conductor layer 44.

Conventionally, wideband balun losses occur mainly in the ferrite core material. The present invention requires no ferrite core for transmission line 34, while in transmission line 40, main line mode losses are minimized by radially centering transmission line 40 in central passage 48 of ferrite core 46 and by increasing the diameter of central passage 48. Losses due to stray couplings and parasitic modes are minimized as discussed hereinabove.

The present invention has a manufacturing and cost advantage over prior art baluns because it requires just a single two-conductor transmission line rather than a pair of such lines. A common method in conventional baluns is to wind a pair of bifilar lines on a two-hole ferrite core. By comparison, the particular construction of the instant embodiment of FIGS. 5, 6 has fewer electrical connections and no coil windings.

A balun device may be electrically characterized for its intended purpose by the measurement of insertion loss in decibels (dB), voltage standing-wave ratio (VSWR) and common-mode rejection in dB. Such measurements have been made on a conventional balun and a balun of the present invention for performance comparison. The conventional device was a 4:1 balun schematically equivalent to that of FIG. 1 and widely available and known as a 75-to-300 ohm matching transformer. It is primarily used in television receiving applications in the frequency range 54–806 MHz. A balun according to the present invention used the construction of FIGS. 5, 6 with ferrite core dimensions in inches of 1.75 length, 0.200 outside diameter and 0.062 hole diameter. Comparative performance curves are shown in FIGS. 7–9 for the frequency range 50–950 MHz. In each graph, a curve nearer to the abscissa represents more ideal performance with regard to ordinate values of insertion loss, VSWR and common-mode rejection. Therefore the balun of the present invention exhibits electrical characteristics superior to those of the conventional type.

It will be apparent to those skilled in the art that in addition to the embodiment of the present invention shown in FIGS. 5 and 6, many variations in the construction and arrangement of transmission lines 34 and 40 are possible in the implementation of baluns 30, 32. One such modification of transmission line structure is shown in FIG. 10 with single-conductor transmission line 34 located beneath signal ground conductor layer 44 and separated by dielectric insulation 60. Ferrite core 46, located above dielectric substrate 42, has central passage 48 which contains two-conductor transmission line 40. This structural geometry provides a space savings in the region above dielectric substrate 42 as well as a high degree of isolation between transmission lines 34 and 40. It will be appreciated that in the structure of FIG. 10, the positions of transmission line 34 and 40, including ferrite core 46, may be interchanged.

Figure 11:
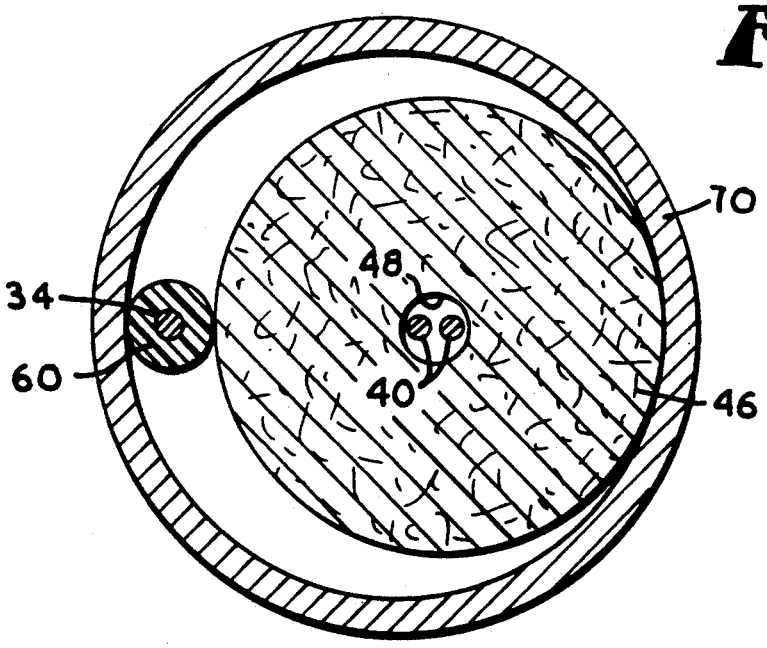
FIG. 11 is a cross sectional view showing a shielded transmission line structural geometry applicable to the present invention.

Another structure is shown in FIG. 11 which includes a shielding tubular signal ground conductor 70. Single-conductor transmission line 34 is placed adjacent to the inner surface of signal ground conductor 70, separated by dielectric insulation 60. A majority of the region remaining inside signal ground conductor 70 is occupied by ferrite core 46 having central passage 48 which contains two-conductor transmission line 40. This shielded structure confines signal energy and prevents coupling to other outside circuits and structures.

Thus there has been provided, in accordance with the present invention, a wideband transmission line balun that fully satisfies the objects and advantages set forth above. While the invention has been described in conjunction with specific embodiments thereof, it is evident that many alternatives, modifications and variations will be apparent to those skilled in the art in light of the foregoing description. Accordingly, the invention is intended to embrace all such alternatives, modifications and variations as fall within the spirit and broad scope of the appended claims.

What is claimed is:

1. A balun for converting between unbalanced and balanced signals and comprising:

(a) a first transmission line having an input and an output;

(b) a second transmission line having an input and an output;

(c) coupling means for dividing a power signal equally between said first transmission line input and said second transmission line input;

(d) said first transmission line and said second transmission line having substantially equal electrical lengths between said respective input and output;

(e) said first transmission line having a single electrical conductor;

(f) said second transmission line having a polarity reversing connection; and (g) said balanced signals being taken at said first transmission line output and said second transmission line output.

2. A balun according to claim 1, further including ferrite means for suppressing parasitic transmission modes associated with said second transmission line.

3. A balun according to claim 1 wherein said second transmission line is wound in a coil configuration.

4. A balun according to claim 1 wherein said second transmission line is substantially one-quarter wavelength long.

5. A balun according to claim 1 wherein said coupling means comprises a parallel connection having said input of said first transmission line connected in parallel with said input of said second transmission line.

6. A balun according to claim 1 wherein said coupling means comprises a series connection having said input of said first transmission line connected in series with said input of said second transmission line.

7. A balun according to claim 1 wherein said first and said second transmission lines have characteristic impedance substantially $2Z_0$ for matching an unbalanced impedance $Z_0$ to a balanced impedance $4Z_0$.

8. A balun according to claim 1 wherein said first and said second transmission lines have characteristic impedance substantially $Z_0/2$ for matching an unbalanced impedance $Z_0$ to a balanced impedance $Z_0$.

9. A balun according to claim 1 wherein said first and said second transmission lines provide impedance transformation between said respective input and output.

10. A balun according to claim 1, further including, (a) a dielectric substrate having first and second opposed, substantially parallel surfaces;

(b) said second surface of said dielectric substrate having a planar signal ground conductor disposed thereon; and (c) said first surface of said dielectric substrate having said first transmission line disposed thereon.

11. A balun according to claim 1, further including:

(a) a dielectric substrate having first and second opposed, substantially parallel surfaces;

(b) said second surface of said dielectric substrate having a planar signal ground conductor disposed thereon; and (c) said first transmission line and said second transmission line being located next to opposite surfaces of said dielectric substrate.

12. A balun according to claim 1, further comprising conductive shielding means for preventing external electrical coupling to said balun.

13. A balun according to claim 12 wherein said first transmission line is placed next to an inner surface of said shielding means.

* * * * *